US008089218B2

(12) United States Patent
Yeh et al.

(10) Patent No.: US 8,089,218 B2
(45) Date of Patent: Jan. 3, 2012

(54) LIGHTING DEVICES

(75) Inventors: Wen-Yung Yeh, Hsinchu County (TW); Jui-Ying Lin, Taipei (TW); Yu-Chen Yu, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 367 days.

(21) Appl. No.: 12/377,596

(22) PCT Filed: Aug. 17, 2007

(86) PCT No.: PCT/CN2007/002485

§ 371 (c)(1),
(2), (4) Date: Feb. 13, 2009

(87) PCT Pub. No.: WO2008/022563

PCT Pub. Date: Feb. 28, 2008

(65) Prior Publication Data

US 2010/0289416 A1 Nov. 18, 2010

(30) Foreign Application Priority Data

Aug. 18, 2006 (CN) ..... 2006 1 0115544

(51) Int. Cl.
*G05F 1/00* (2006.01)

(52) U.S. Cl. ..... 315/295; 315/312; 315/192; 315/185 R; 315/86; 362/543; 362/545; 362/630; 362/631

(58) Field of Classification Search ..... 315/86, 315/90, 185 R, 185 S, 192, 193, 294, 295, 315/312, 316, 320; 362/543–545, 555, 630, 362/631
See application file for complete search history.

(56) References Cited

U.S. PATENT DOCUMENTS

| | | | | |
|---|---|---|---|---|
| 5,283,474 | A * | 2/1994 | Oi et al. | 307/116 |
| 6,201,353 | B1 | 3/2001 | Chang et al. | |
| 7,161,311 | B2 * | 1/2007 | Mueller et al. | 315/294 |
| 7,195,381 | B2 * | 3/2007 | Lynam et al. | 362/494 |
| 7,281,820 | B2 * | 10/2007 | Bayat et al. | 362/245 |
| 7,714,348 | B2 * | 5/2010 | Fan et al. | 257/99 |

FOREIGN PATENT DOCUMENTS

| | | |
|---|---|---|
| CN | 1312666 A | 9/2001 |
| CN | 1342388 A | 3/2002 |

(Continued)

OTHER PUBLICATIONS

Intellectual Property Office of Singapore, Notice of Allowance, Application Serial No. 200900834-3, Feb. 15, 2011, Singapore.

(Continued)

*Primary Examiner* — Haiss Philogene

(57) ABSTRACT

Lighting devices capable of being powered by both AC and DC power sources without requiring AC power source to the DC power source conversion are provided, in which a lighting module comprises a plurality of micro-diodes formed on a substrate and a conductive wire pattern connecting to the micro-diodes, wherein the conductive wire pattern has at least three voltage feed points. A selection unit is coupled to a power source and selects at least two of the voltage feed points, such that a portion of the micro-diodes and the power source form at least one loop thereby turning on the micro-diodes in the loop.

20 Claims, 19 Drawing Sheets

FOREIGN PATENT DOCUMENTS

| | | | |
|---|---|---|---|
| CN | 2528184 | Y | 12/2002 |
| JP | 2002-016290 | | 1/2002 |
| JP | 2004-119422 | | 4/2004 |
| JP | 2004-297630 | | 10/2004 |
| JP | 3117237 | | 11/2005 |
| JP | 2006-147933 | | 6/2006 |
| JP | 2007-173548 | | 7/2007 |

OTHER PUBLICATIONS

Korean Intellectual Property Office, Notice to Submit Response, Korean Patent Application Serial No. 10-2009-7002290, Nov. 8, 2010, Korea.

Japan Patent Office, Office Action, Patent Application Serial No. 2009-524876, Aug. 2, 2011, Japan.

* cited by examiner

LIGHTING DEVICES

FIELD OF THE INVENTION

The invention relates to lighting devices comprising micro-diodes, and in particular to lighting devices comprising micro-diodes, which are capable of being powered by AC and DC power sources without requiring AC power source to DC power source conversion.

DESCRIPTION OF THE RELATED ART

Due to durability, lifespan, a thin profile, light weight, low power consumption and no pernicious substances such as mercury (Hg), lighting technology using light emitting diodes (LEDs) has become a significant trend for the future of the lighting and semiconductor industries. Generally, LEDs are widely employed in white light emitting devices, guiding lights, car strobe lights, car lights, flashlights, back light modules for LCDs, light sources for projectors, outdoor display units and the like.

Current LED light sources cannot work with an alternating current (AC) power source directly, and thus, AC/DC converters are required to convert the AC power source to a direct current (DC) power source for the LED light sources. However, AC/DC converters increase a product's cost, size and weight, consume more power, and result in more inconvenience for portable devices. Thus, there is a need for an LED lighting device capable of being powered by AC and DC power sources without requiring AC power source to DC power source conversion.

BRIEF SUMMARY OF THE INVENTION

Embodiments of a lighting device are provided, in which a lighting module comprises a plurality of micro-diodes formed on a substrate and a conductive wire pattern connecting to the micro-diodes, wherein the conductive wire pattern has at least three voltage feed points. A selection unit is coupled to a power source and selects at least two of the voltage feed points, such that a portion of the micro-diodes and the power source form at least one loop thereby turning on the micro-diodes in the loop.

The invention also provides another embodiment of a lighting device, in which a lighting module comprises a plurality micro-diodes formed on a substrate, and a conductive wire pattern connecting to the micro-diodes. At least two alternating current (AC) electrodes are used to electrically couple an AC power source to the micro-diodes by the conductive wire pattern, such that a first portion of the micro-diodes are turned on during a positive half cycle of the AC power source and a second portion of the micro-diode are turned on during a negative half cycle of the AC power source. At least two direct current (DC) electrodes are used to couple a DC power source to the micro-diodes by the conductive wire pattern.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
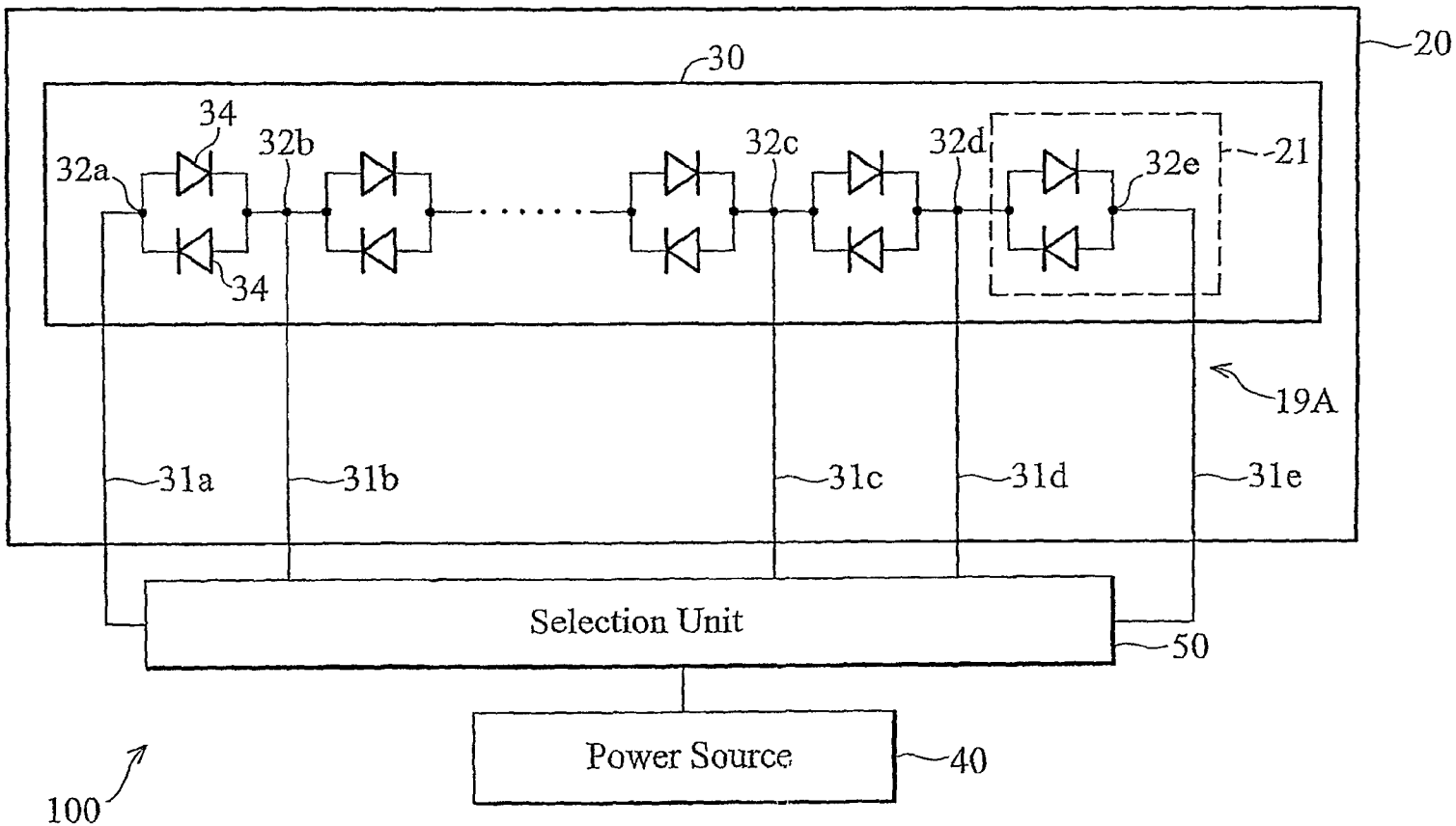
FIG. 1 shows an embodiment of a lighting device.

FIG. 1 shows an embodiment of a lighting device. As shown, the lighting device 100 comprises a lighting module 30 and a selection unit 50. The lighting module 30 comprises a plurality of micro-diodes 34 formed on a substrate 20 and a conductive wire pattern 19A connecting to the micro-diodes 34. The substrate 20 can be an isolation substrate or material or structure capable of electrically isolating micro-diodes 34 individually.

Figure 7:
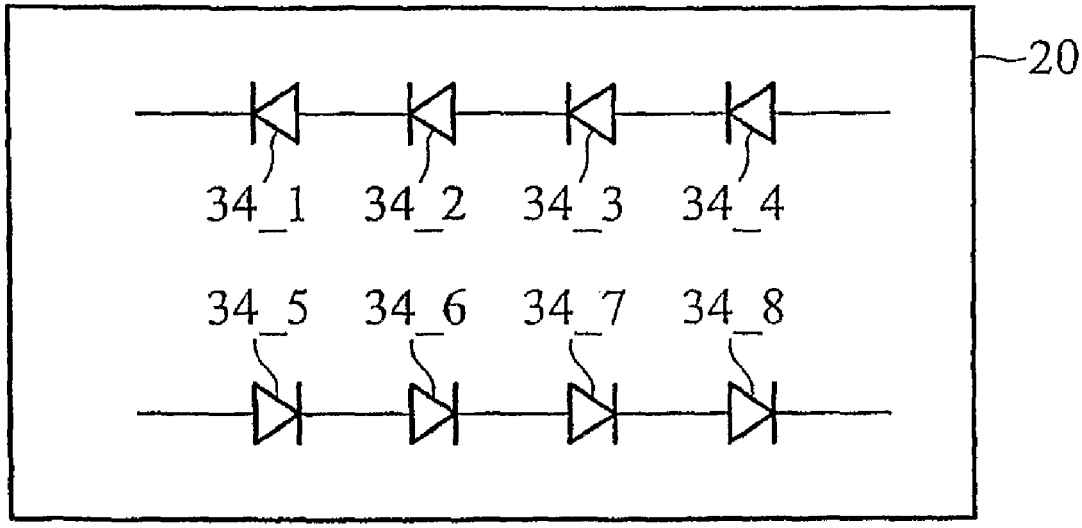
FIG. 7 is a diagram showing a substrate with a plurality of micro-diodes.

The conductive wire pattern 19A comprises conductive wires connecting to the micro-diodes 34 in a series of micro-lighting units 21, conductive wires (i.e. 31*a*~31*e*) coupling the micro-diodes 34 to the selection unit 50, and a plurality of voltage feed points (i.e. 32*a*~32*e*) receiving the voltages provided by the power source 40 through the selection unit 50. For example, the conductive wire pattern 19A can be formed by a plurality of conductive wires on the substrate 20, a plurality of conductive wires of a submount (as shown in FIG. 7) or combinations thereof, but is not limited thereto. Each micro-lighting unit 21 comprises at least two micro-diodes 34 which are reversely connected in parallel, but is not limited thereto. In some embodiments, each micro-lighting unit 21 can also comprise more than three micro-diodes 34 connected in parallel, in series or in series-parallel. Alternatively, the micro-diodes 34 on the substrate 20 can also be connected to form a plurality of micro-lighting units 21 connected in parallel or in series-parallel.

The power source 40, for example, can be a direct current (DC) power source, an alternating current (AC) power source. The micro-diodes 34 can be lighting elements capable of adjusting operating power thereof non-linearly according to different operating voltages. For example, the micro-diodes 34 can be micro-LEDs (light emitting diodes) or micro-LDs (laser diodes), but are not limited thereto. As shown, the voltage feed points 32*a*~32*e*, each connects to the selection unit 50 through corresponding conductive wires 31*a*~31*e*.

The selection unit 50 is coupled between the power source 40 and the lighting module 30, controlling the power source 40 to provide current through at least two of the conductive wires 31*a*~31*e*, thereby powering one or more of the micro-lighting units 21. Namely, the selection unit 50 selects at least two voltage feed points from the voltage feed points 32*a*~32*e* and couples the voltage provided by the power source 40 to the micro-lighting units 21 through the selected voltage feed points, such that a portion of the micro-diodes 34 in the series of the micro-lighting units 21 and the power source 40 form at least one loop thereby turning on the micro-diodes 34 in the loop.

When the voltage feed points 32*a* and 32*c* are selected by the selection unit 50, voltages, for example a higher voltage (VDD) and a lower voltage (GND), provided by the power source 40 are coupled to N micro-lighting units 21 connected in a series through the conductive wires 31*a* and 31*c*. Hence, the N micro-lighting units 21 and the power source 40 form a loop through the conductive wires 31*a* and 31*c*, i.e., the conductive wires 31*a* and 31*c* are coupled to first and second electrodes (not shown) of the power source 40 respectively. If the power source 40 is an AC power source, the bottom series of N micro-diodes 34 are forward biased (i.e. turned on) when the voltages of the first and second electrodes are negative (i.e. low) and positive (i.e., high) respectively, such as during the positive half cycle of the power source 40. On the contrary, the upper series of N micro-diodes 34 are forward biased (i.e., turned on) when the voltages of the first and second electrodes are positive (i.e. high) and negative (i.e. low) respectively, such as during the negative half cycle of the power source 40.

If the power source 40 is a DC power source, the bottom series of N micro-diodes 34 are forward biased (i.e. turned on) when the voltages of the first and second electrodes are negative and positive respectively. On the contrary, the upper series of N micro-diodes 34 are forward biased (i.e., turned on) when the voltages of the first and second electrodes are positive and negative respectively.

When the voltage feed points 32*a* and 32*d* are selected by the selection unit 50, voltages provided by the power source 40 are coupled to N+1 micro-lighting units 21 connected in a series through the conductive wires 31*a* and 31*d*, such that the N+1 micro-lighting units 21 and the power source 40 form a loop through the conductive wires 31*a* and 31*d*. Namely, the conductive wires 31*a* and 31*d* are coupled to first and second electrodes of the power source 40 respectively. If the power source 40 is an AC power source, the bottom series of N+1 micro-diodes 34 are forward biased (i.e. turned on) when the voltages of the first and second electrodes are negative and positive respectively, such as during the positive half cycle of the AC power source. On the contrary, the upper series of N+1 micro-diodes 34 are forward biased (i.e., turned on) when the voltages of the first and second electrodes are positive and negative respectively, such as during the negative half cycle of the AC power source.

Alternatively, when the voltage feed points 32*a* and 32*e* are selected by the selection unit 50, voltages provided by the power source 40 are coupled to N+2 micro-lighting units 21 connected in a series through the conductive wires 31*a* and 31*e*, such that the N+2 micro-lighting units 21 and the power source 40 form a loop through the conductive wires 31*a* and 31*e*.

For example, an equivalent withstand voltage of N micro-diodes 34 connected can be Vn, an equivalent withstand voltage of N+1 micro-diodes 34 connected can be Vn+1 and an equivalent withstand voltage of N+2 micro-diodes 34 connected can be Vn+2, and so on. If the magnitude of the power source 40 is less than the equivalent withstand voltage Vn+1 of N+1 micro-diodes 34 connected in series, the selection unit 50 selects the voltage feed points 32*a* and 32*c* such that voltages provided by the power source 40 are coupled to N micro-lighting units 21 connected in a series through the conductive wires 31*a* and 31*c*. Alternatively, if the voltages provided by the power source 40 exceed the equivalent withstand voltage Vn+1 of N+1 micro-diodes 34 connected in series, the selection unit 50 selects the voltage feed points 32*a* and 32*e* such that voltages provided by the power source 40 are coupled to N+2 micro-lighting units 21 connected in a series through the conductive wires 31*a* and 31*e*. Namely, the selection unit 50 can select voltage feed points to change the number of micro-diodes 34 biased by the power voltage 40 according to a relationship between the power source 40 and the equivalent withstand voltages of the micro-diodes 34 connected in series, thereby solving the variation in equivalent withstand voltage caused by semiconductor processes.

Figure 2:
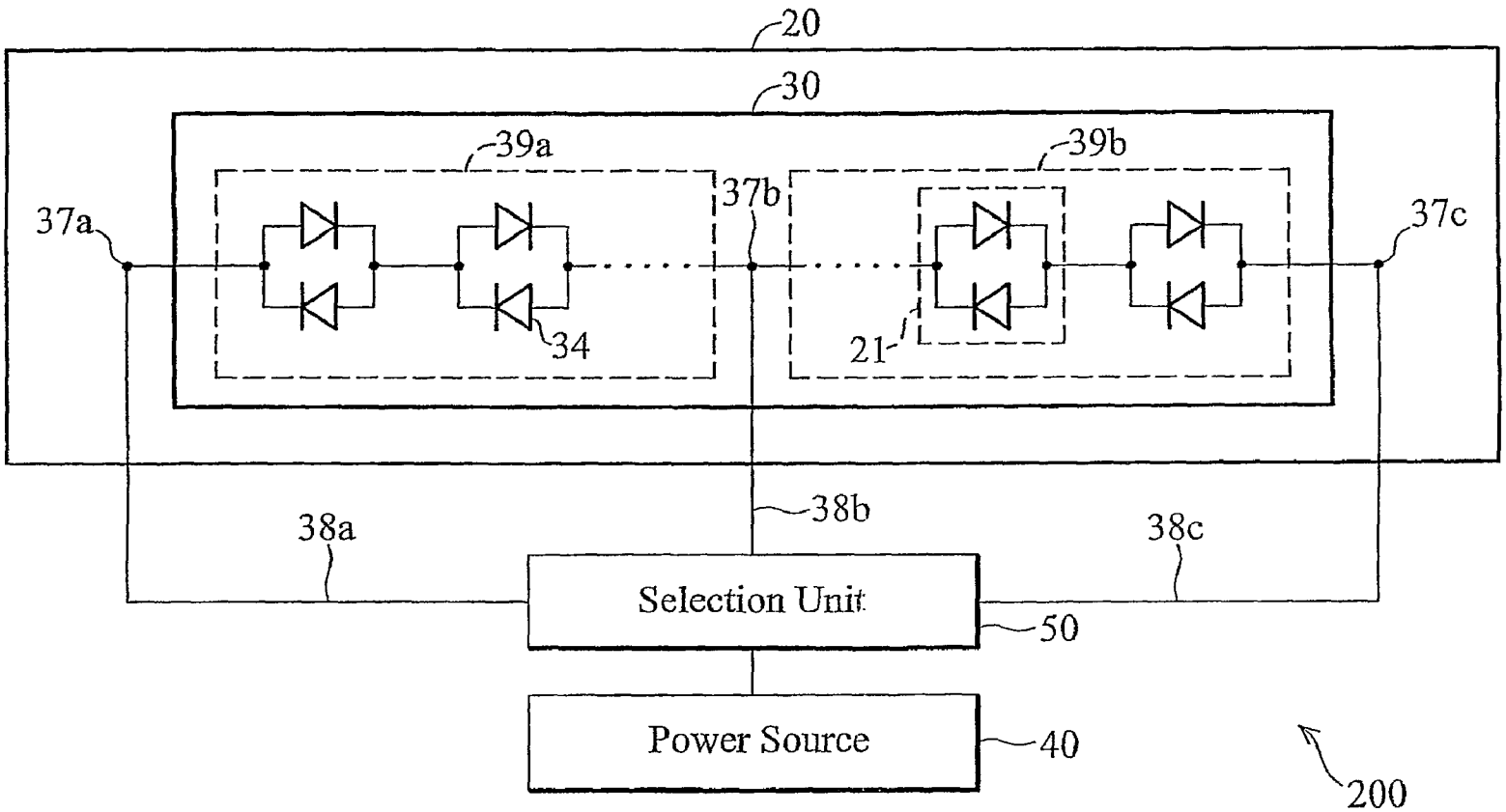
FIG. 2 shows another embodiment of a lighting device.

FIG. 2 shows another embodiment of the lighting device. As shown, the lighting device 200 is similar to the lighting device 100 shown in FIG. 1, differing only in that the lighting module 30 is divided into two lighting sub-modules 39*a* and 39*b* and the selection unit 50 selects at least two of the voltage feed points 37*a*~37*c* such that the power source 40 provides voltages to the micro-diodes 34 through conductive wires connected to the selected two voltage feed points according to magnitude of the power source 40.

For example, the lighting module 30 comprises N micro-lighting units 21, and the lighting sub-modules unit 39*a* and 39*b* each comprises $$\frac{N}{2}$$

micro-lighting units 21, and each micro-lighting unit 21 comprises two micro-diodes 34 which are reversely connected in parallel, but is not limited thereto. In other embodiments, the lighting sub-modules unit 39*a* and 39*b* may comprise different numbers of micro-lighting units 21

When the power source 40 is AC 220V, the selection unit 50 selects voltage feed points 37*a* and 37*c*, such that the power source 40 provides voltages to the selected voltage feed points 37*a* and 37*c* through the wire 38*a* and 38*c*. Namely, the conductive wires 38*a* and 38*c* are coupled to first and second electrodes (not shown) of the power source 40 respectively and the entire lighting module 30 and the power source 40 form a loop through the conductive wires 38*a* and 38*c*. Hence, the bottom series of N micro-diodes 34 are forward biased (turned on) when the voltages of the first and second electrodes are negative and positive respectively, such as during the negative half cycle of the power source 40. On the contrary, the upper series of N micro-diodes 34 are forward biased (turned on) when the voltages of the first and second electrodes are negative and positive respectively, such as during the positive half cycle of power source 40.

When the power source 40 is AC 110V, the selection unit 50 selects three voltage feed points 37*a*~37*c* such that the power source 40 provides voltages to the wire 38*a*~38*c* respectively, and the lighting sub-modules 39*a* and 39*b* and the power source 40 form two loops through the conductive wires 38*a*~38*c*. For example, the lighting sub-module 39*a* and the power source 40 form a loop through the conductive wires 38*a* and 38*b* and the lighting sub-module 39*b* and the power source 40 form another loop through the conductive wires 38*b* and 38*c*. Namely, the conductive wires 38*a* and 38*c* are coupled to the first electrode of the power source 40, and the wire 38*b* is coupled to a second electrode of the power source 40. Hence, the upper series of $$\frac{N}{2}$$

micro-diodes 34 in the lighting sub-module 39*a* are forward biased (turned on) and the bottom series of $$\frac{N}{2}$$

micro-diodes 34 in the lighting sub-module 39*b* are forward biased (turned on) when the voltages of the first and second electrodes are positive and negative respectively, such as during the negative half cycle of the power source 40. On the contrary, the bottom series of $$\frac{N}{2}$$

micro-diodes 34 in the lighting sub-module 39*a* and the upper series of $$\frac{N}{2}$$

micro-diodes 34 in the lighting sub-module 39*b* are both forward biased (turned on) when the voltages of the first and second electrodes are negative and positive respectively, such as during the positive half cycle of the power source 40.

Thus, the lighting device 200 selects an appropriate loop according to the magnitude of the power source 40, such that it can be powered with both AC 220V and AC 110V. In addition, the lighting device 200 can also be powered with a DC power source. For example, if the power source 40 is a DC power source, the bottom series of N micro-diodes 34 are forward biased (i.e. turned on) when the voltages of the first and second electrodes are negative and positive respectively. On the contrary, the upper series of N micro-diodes 34 are forward biased (i.e., turned on) when the voltages of the first and second electrodes are positive and negative respectively.

Figure 3:
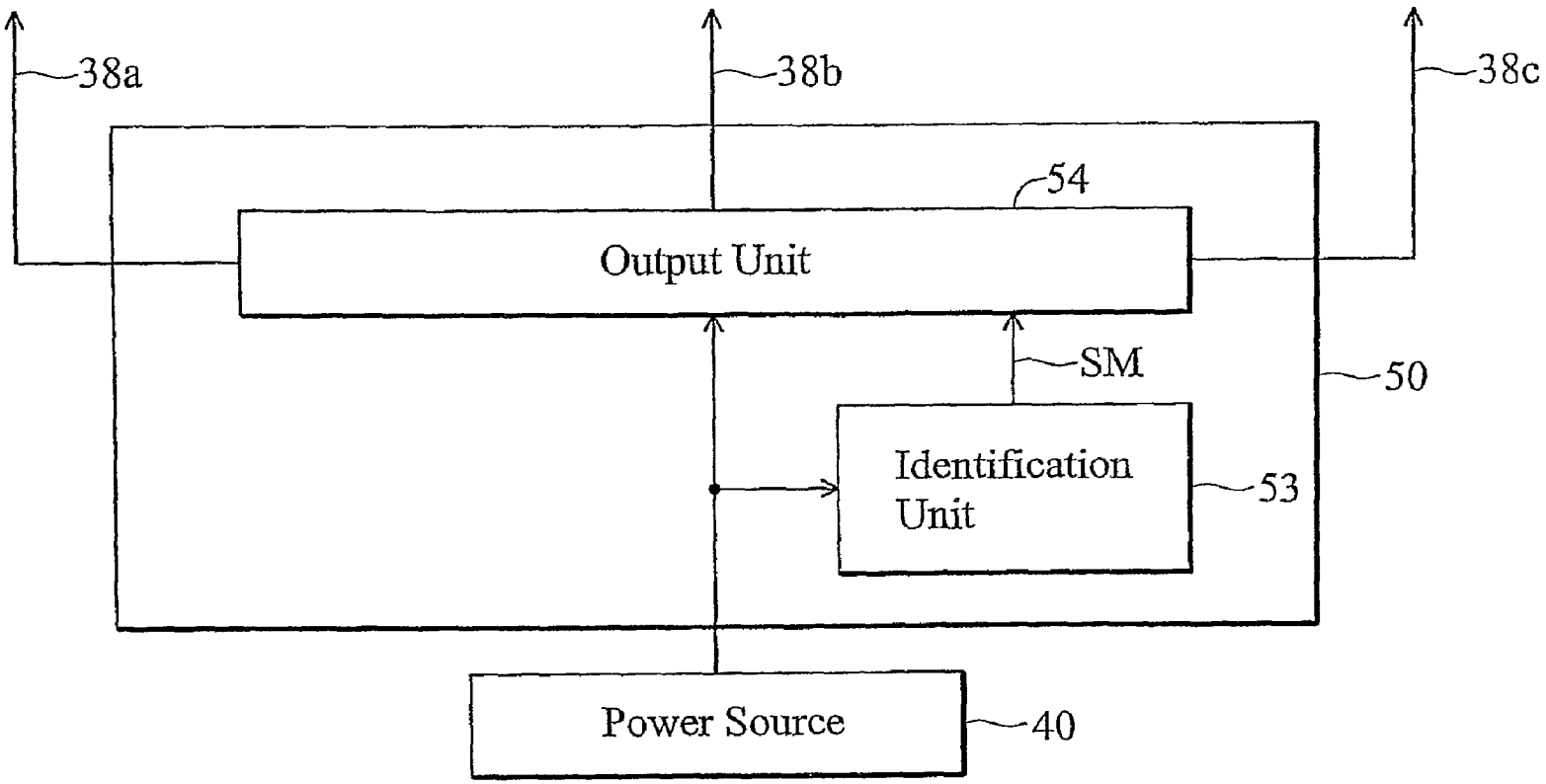
FIG. 3 shows an embodiment of the selection unit.

FIG. 3 shows an embodiment of the selection unit. As shown, the selection unit 50 comprises an identification unit 53 and an output unit 54. The identification unit 53 is coupled to the power source 40 to determine the magnitude of the power source 40 and accordingly generate a result signal SM. The output unit 54 is coupled to the power source 40 and the identification unit 53, selectively coupling the power source 40 to at least two voltage feed points according to the result signal SM.

For example, when the power source 40 is AC/DC 220V, the identification unit 53 generates the result signal SM to the output unit 54, such that the output unit 54 outputs the voltages from the power source 40 to the selected voltage feed points 37*a* and 37*c* through the wires 38*a* and 38*c*. Namely, the conductive wires 38*a* and 38*c* are coupled to first and second electrodes of the power source 40 respectively and the entire lighting module 30 and the power source 40 form a loop through the conductive wires 38*a* and 38*c*.

When the power source 40 is AC/DC 110V, the identification unit 53 generates the result signal SM to the output unit 54, such that the output unit 54 outputs the voltages from the power source 40 to selected voltage feed points 37*a*~37*c* through the wires 38*a*~38*c*. Hence, the lighting sub-modules 39*a* and 39*b* and the power source 40 form two loops through the conductive wires 38*a*~38*c*. For example, the conductive wires 38*a* and 38*c* are coupled to a first electrode of the power source 40, and the wire 38*b* is coupled to a second electrode of the power source 40. The lighting sub-module 39*a* and the power source 40 form a first loop through the conductive wires 38*a* and 38*b* and the lighting sub-module 39*b* and the power source 40 form a second loop through the conductive wires 38*b* and 38*c*.

Figure 4:
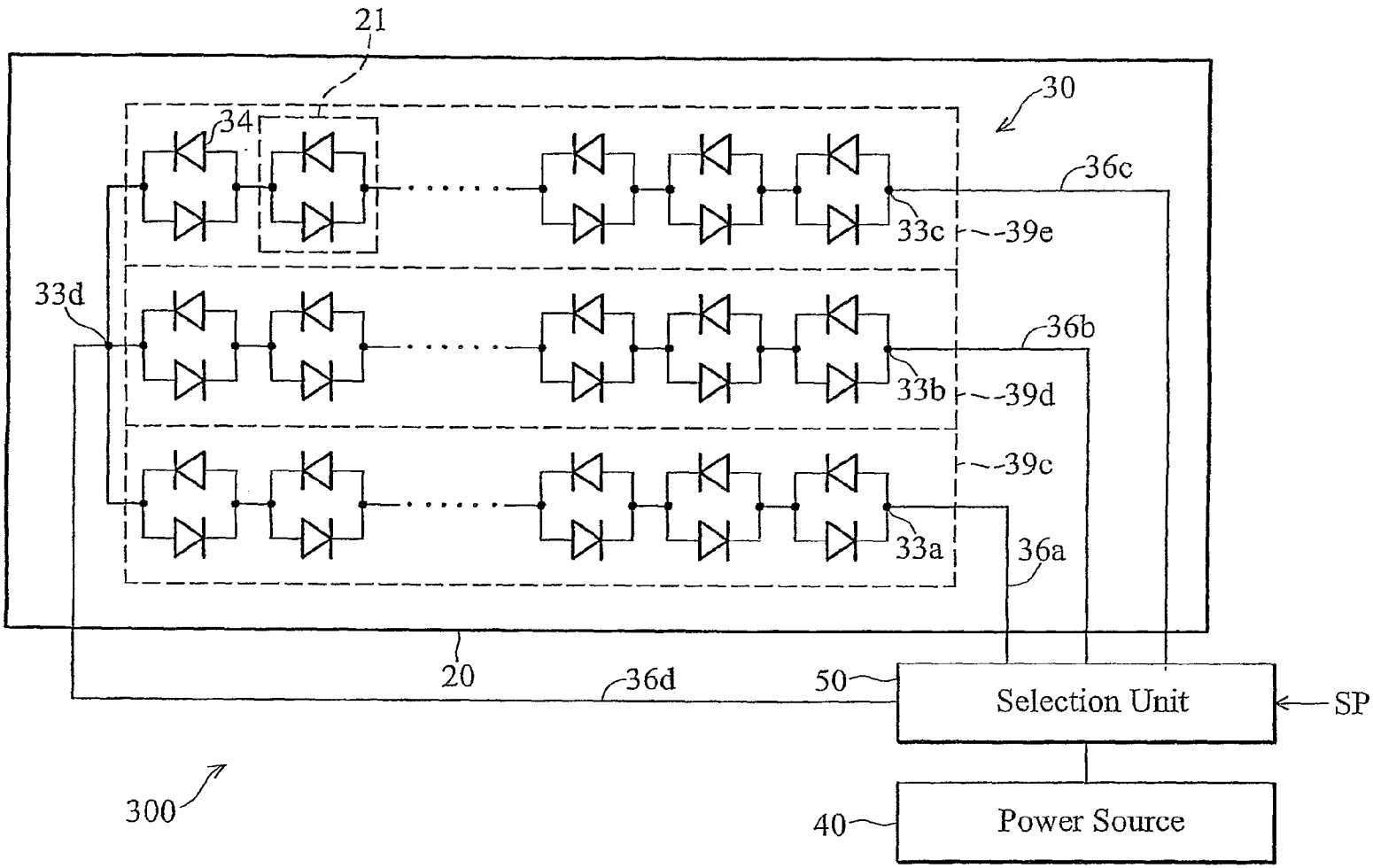
FIG. 4 shows another embodiment of a lighting device.

FIG. 4 shows another embodiment of a lighting device. As shown, the lighting device 300 is similar to the lighting device 100 shown in FIG. 1, differing only in that the lighting module 30 comprises three lighting sub-modules 39*c*~39*e*, each comprising a series of micro-lighting units 21, and the selection unit 50 selects two of the voltage feed points 33*a*~33*d* such that the power source 40 provides voltages to the micro-diodes 34 through corresponding conductive wires connected to the selected two voltage feed points according to a power setting signal SP. As shown, each micro-lighting unit 21 comprises at least two micro-diodes 34 which are reversely connected in parallel, but is not limited thereto. In some embodiments, each micro-lighting unit 21 can also comprise more than three micro-diodes 34 connected in parallel, in series or in series-parallel. Alternatively, the micro-diodes 34 on the substrate 20 can be connected to form a plurality of micro-lighting units 21 connected in parallel, in series or in series-parallel.

When the power setting signal SP represents a first condition, the selection unit 50 selects the voltage feed points 33*d* and 33*a* and couples the conductive wires 36*d* and 36*a* to first and second electrodes of the power source 40 respectively. Hence, the power source 40 and the series of micro-lighting unit 21 in the lighting sub-module 39*c* form a loop. The upper series of micro-diodes 34 in the lighting sub-module 39*c* are forward biased (i.e. turned on) when the voltages of the first and second electrodes are negative and positive respectively. On the contrary, the bottom series of micro-diodes 34 in the lighting sub-module 39*c* are forward biased (i.e., turned on) when the voltages of the first and second electrodes are positive and negative respectively.

When the power setting signal SP represents a second condition, the selection unit selects the voltage feed points 33*d*, 33*a* and 33*b*, couples the wire 36*d* to a first electrode of the power source 40 and couples the wire 36*a* and 36*b* to the second electrode of the power source 40. Hence, the power source 40 and the series of micro-lighting units 21 in the lighting sub-module 39*c* form a first loop and the power source 40 and the series of micro-lighting units 21 in the lighting sub-module 39*d* form a second loop. The upper series of micro-diodes 34 in the both lighting sub-modules 39*c* and 39*d* are forward biased (i.e. turned on) when the voltages of the first and second electrodes are negative and positive respectively. On the contrary, the bottom series of micro-diodes 34 in the both lighting sub-modules 39*c* and 39*d* are forward biased (i.e., turned on) when the voltages of the first and second electrodes are positive and negative respectively.

When the power setting signal SP represents a third condition, the selection unit selects the voltage feed points 33*a*~33*d* and couples the wire 36*d* to a first electrode of the power source 40 and couples the wire 36*a*~36*c* to the second electrode of the power source 40. Hence, the power source 40 and the series of micro-lighting unit 21 in the lighting sub-module 39*c* form a first loop, the power source 40 and the series of micro-lighting unit 21 in the lighting sub-module 39*d* form a second loop and the power source 40 and the series of micro-lighting unit 21 in the lighting sub-module 39*e* form a third loop. The upper series of micro-diodes 34 in the three lighting sub-modules 39*c*~39*e* are forward biased (i.e. turned on) when the voltages of the first and second electrodes are negative and positive respectively. On the contrary, the bottom series of micro-diodes 34 in the three lighting sub-modules 39*c*~39*e* are forward biased (i.e., turned on) when the voltages of the first and second electrodes are positive and negative respectively.

Thus, the lighting device 300 can selectively bias one or more series of micro-lighting unit 21 to adjust lighting power thereof according to the power setting signal SP. For example, the power setting signal can be generated by a switching device.

Figure 5:
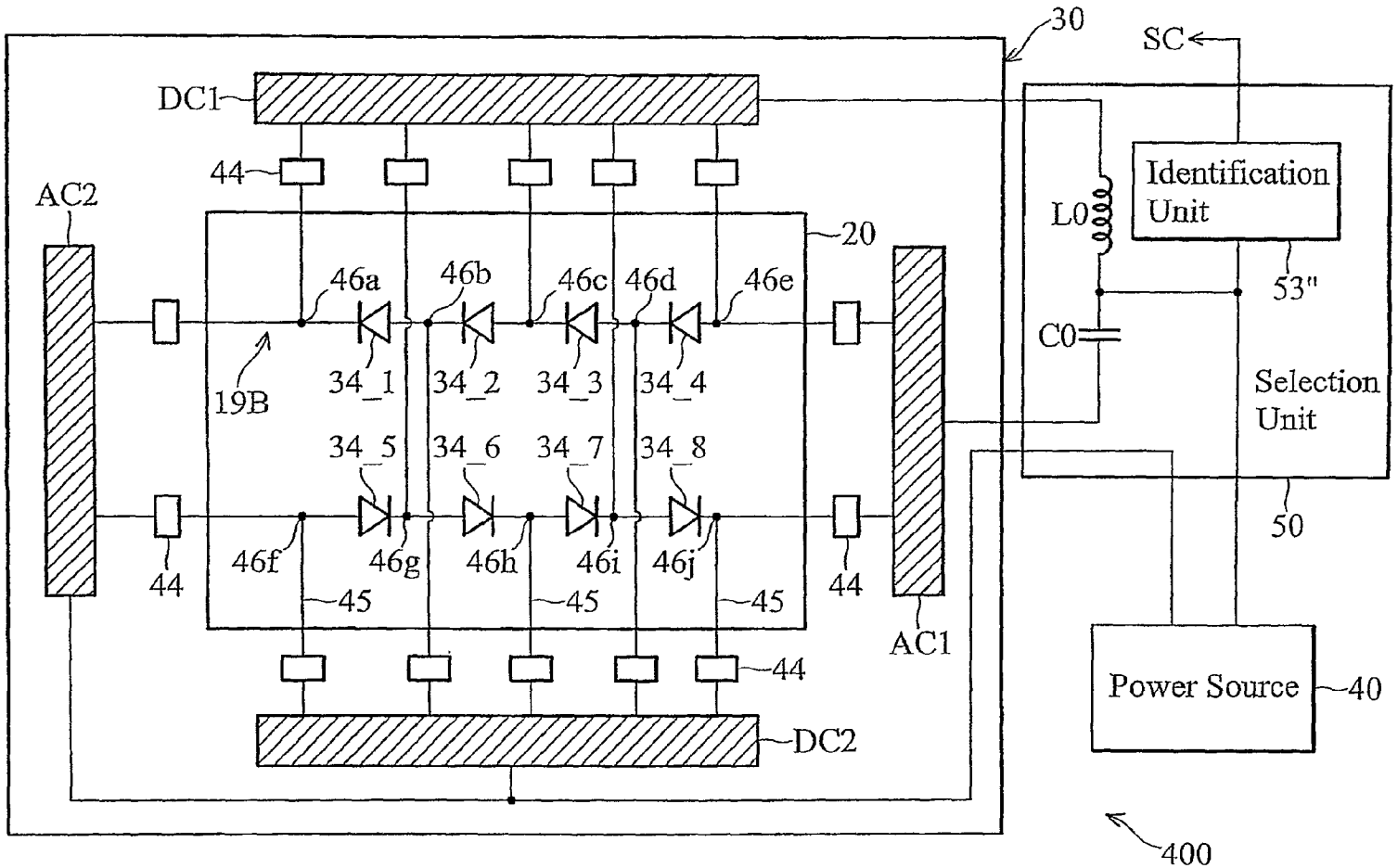
FIG. 5 shows another embodiment of a lighting device.

FIG. 5 shows another embodiment of a lighting device. As shown, the lighting device 400 comprises a lighting module 30, a power source 40, and a selection unit 50. The power source 40 can be a direct current (DC) power source, an altering current (AC) power source. The lighting module 30 comprises a plurality of micro-diodes 34_1~34_8 formed on a substrate 20 and a conductive wire pattern 19B connecting to the micro-diodes 34_1~34_8. The substrate 20 can be an isolation substrate or material or structure capable of electrically isolating micro-diodes 34_1~34_8 individually.

The conductive wire pattern 19B comprises a plurality of conductive wires 45 connecting to the micro-diodes 34_1~34_8 in two series of micro-diodes and coupling the micro-diodes 34_1~34_8 to the selection unit 50, and a plurality of voltage feed points (i.e. 46*a*~46*j*) receiving the voltage provided by the power source 40 through the selection unit 50. For example, the conductive wire pattern 19B can be formed by a plurality of conductive wires on the substrate 20, a plurality of conductive wires of a submount 22 (shown in FIG. 7) or combinations thereof, but is not limited thereto. In some embodiments, the micro-diodes 34_1~34_8 on the substrate 20 can also be connected in parallel or series-parallel. For example, the micro-diodes 34_1~34_8 can be micro-LEDs (light emitting diodes) or micro-LDs (laser diodes), but is not limited thereto.

The selection unit 50 selectively applies the voltages provided by the power source 40 to the voltage feed points 46*a*~46*j* by determining whether the power source 40 is AC or DC. The selection unit 50 comprises an identification unit 53, a plurality of isolation units 44, an inductor L0, a capacitor C0, AC and DC electrodes AC1, AC2, DC1 and DC2. As shown, through the conductive wires 45, the voltage feed points 46*a*, 46*c*, 46*e*, 46*g* and 46*i* are connected to the DC electrode DC1, the voltage feed points 46*b*, 46*d*, 46*f*, 46*h* and 46*j* are connected to the DC electrode DC2, the voltage feed points 46*e* and 46*j* are connected to the AC electrode AC1 and the voltage feed points 46*a* and 46*f* are connected to the AC electrode AC2.

The identification unit 53 determines whether the power source 40 is DC or AC and generates a determined result SC to control the isolation units 44. The inductor L0 is coupled between the power source 40 and the DC electrode DC1 to isolate AC signals and the capacitor C0 is coupled between the power source 40 and the AC electrode AC1 to isolate DC signals. The isolation units 44 are coupled between the conductive wire pattern 19B and the AC and DC electrodes AC1, AC2, DC1 and DC2, electrically isolating the AC and DC electrodes AC1, AC2, DC1 and DC2 from the voltage feed points 46*a*~46*j* of the conductive wire pattern 19B.

For example, when the power source 40 is DC, the determined result SC controls the isolation units 44 to electrically isolate the AC electrodes AC1 and AC2 from the voltage feed points 46*a*, 46*e*, 46*f* and 46*j* while electrically coupling the voltage feed points 46*b*~46*e* and 46*g*~46*j* to the DC electrode DC1 and DC2 respectively. The higher voltage (i.e., VDD) of the power source 40 is coupled to the voltage feed points 46*g*, 46*c*, 46*i* and 46*e* through the inductor L0 and the DC electrode DC1, and the lower voltage (i.e., GND) is coupled to the voltage feed 46*b*, 46*h*, 46*d* and 46*j* though the DC electrode DC2. Thus, the micro-diodes 34_2, 34_4, 34_6 and 34_8 are forward biased (turned on) individually by the power source 40. Namely, the power source 40 and the micro-diodes 34_2, 34_4, 34_6 and 34_8 form four loops by the DC electrodes DC1 and DC2 and the conductive wire pattern 19B (i.e. conductive wires on the lighting module 30).

On the contrary, when the power source 40 is AC, the determined result SC controls the isolation units 44 to electrically isolate the DC electrodes DC1 and DC2 from the voltage feed points 46*a*~46*j* while electrically coupling the voltage feed points 46*e* and 46*j* to the AC electrode AC1 and the voltage feed points 46*a* and 46*f* to the AC electrode AC2. The series of micro-diodes 34_1~34_4 are forward biased (turned on) and the micro-diodes 34_5~34_8 are reversely biased (turned off) through the capacitor C0 and the AC electrodes AC1 and AC2 by the power source 40 during a positive half cycle of the power source 40. The series of micro-diodes 34_5~34_8 are forward biased (turned on) and the micro-diodes 34_1~34_4 are reversely biased (turned off) through the capacitor C0 and the AC electrodes AC1 and AC2 by the power source 40 during a negative half cycle of the power source 40. Thus, the series of the micro-diodes 34_1~34_4 and the series of micro-diodes 34_5~34_8 are forward biased in turn by the power source 40. Namely, the power source 40 and the micro-diodes 34_1~34_8 form two loops by the AC electrodes AC1 and AC2 and the conductive wire pattern 19B (i.e. conductive wires on the lighting module 30).

In operation, the lighting device 400 determines whether the power source 40 is AC or DC and then couples the power source 40 to corresponding electrodes AC1, AC2, DC1 or DC2 according to the determined result, such that different voltage feed points can be selected for different types of power sources. Thus, the lighting device 400 can be powered with both an AC power source and a DC power source without requiring AC power source and the DC power source conversion.

Figure 6:
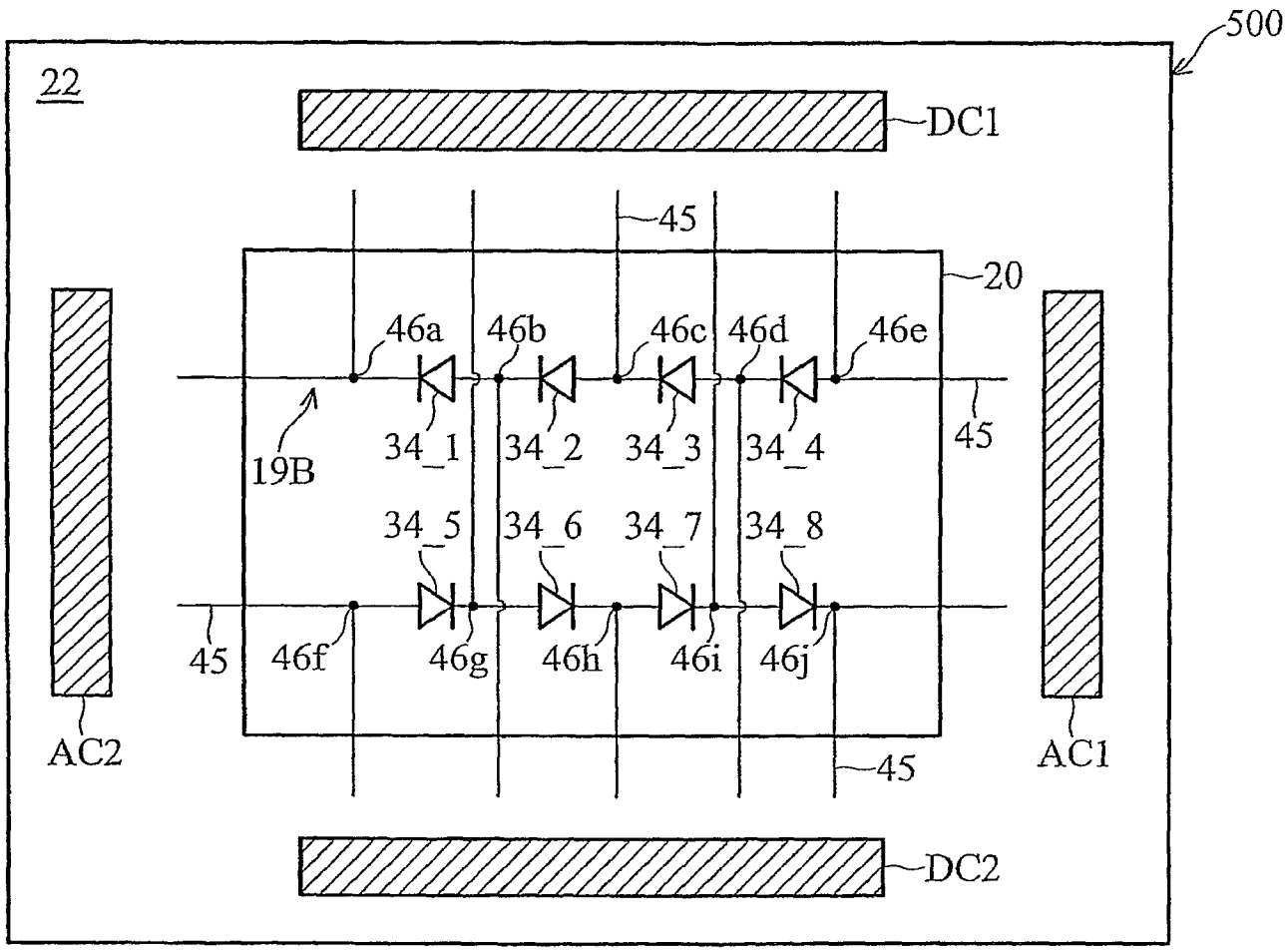
FIG. 6 shows another embodiment of a lighting device.

FIG. 6 shows an embodiment of a lighting device. As shown, the lighting device 500 is similar to the lighting device 400 shown in FIG. 5, differing only in that the isolation units 44 are omitted and the AC electrodes AC1 and AC2 and the DC electrodes DC1 and DC2 are movable rather than fixed.

Figure 8:
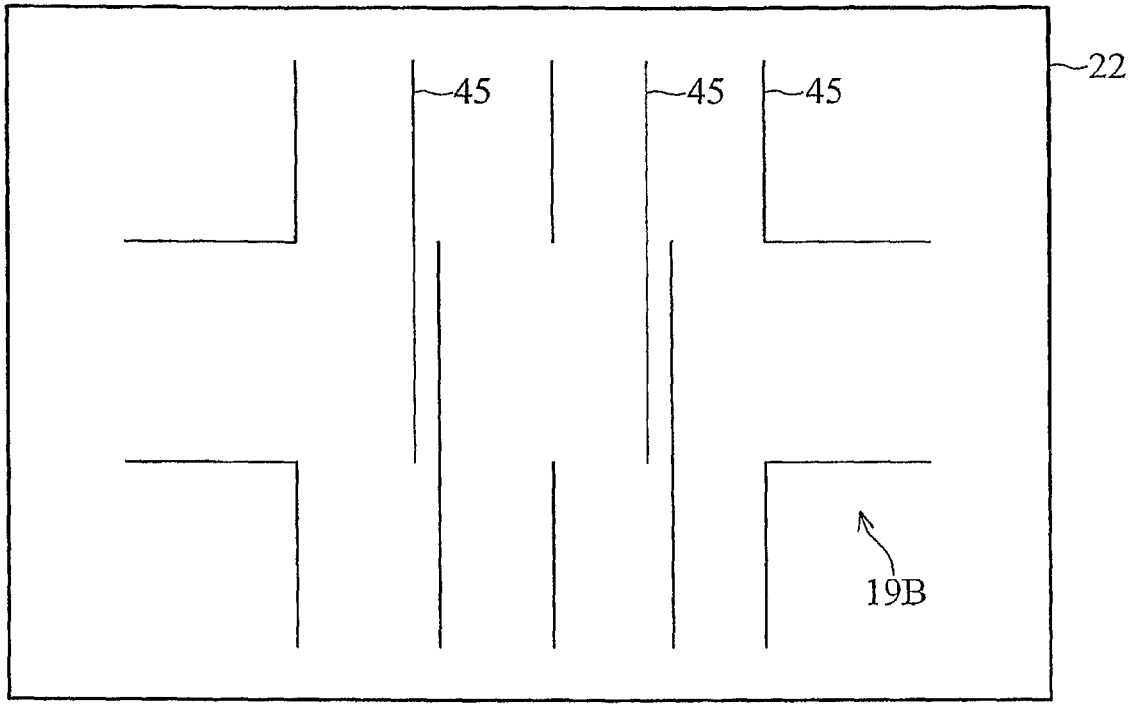
FIG. 8 is a diagram showing a submount with a plurality of conductive wires.
Figure 9:
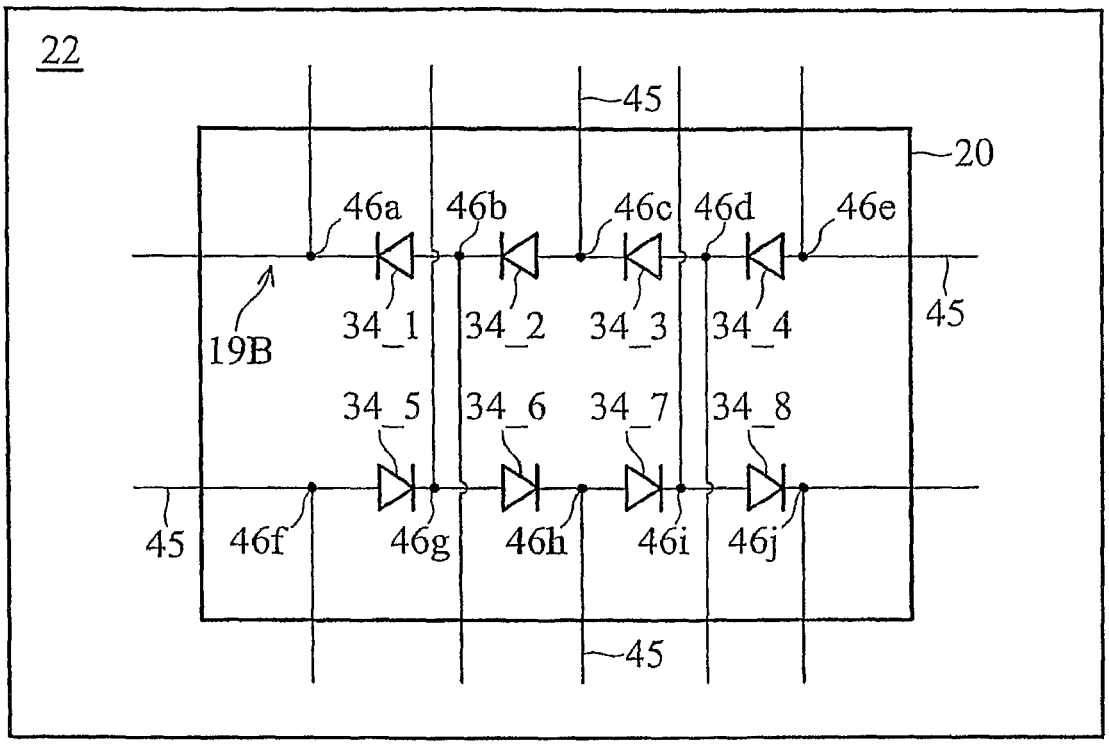
FIG. 9 is a diagram showing the combination of the substrate and the submount shown in FIGS. 7 and 8.

The lighting device 500 can be formed according to steps as follow. First, as shown in FIG. 7, a plurality of micro-diodes 34_1~34_8 are formed on a substrate 20 by normal semiconductor processes in which the micro-diodes 34_1~34_8 are connected in two series by conductive wires on substrate 20. For example, micro-diodes 34_1~34_4 are connected in a first series and the micro-diodes 34_5~34_8 are connected in a second series. Then, as shown in FIG. 8, a submount 22 with a plurality of conductive wires 45 thereon is provided, and the substrate 22 with micro-diodes 34_1~34_8 is disposed on the submount 22. As shown in FIG. 9, the conductive wires 45 on the submount 22 and the micro-diodes 34_1~34_8 are electrically connected by a flip-chip bonding method. Finally, the DC and AC electrodes DC1, DC2, AC1 and AC2 are movably disposed on the submount 22 to complete the lighting device 500 as shown in FIG. 6.

Figure 10:
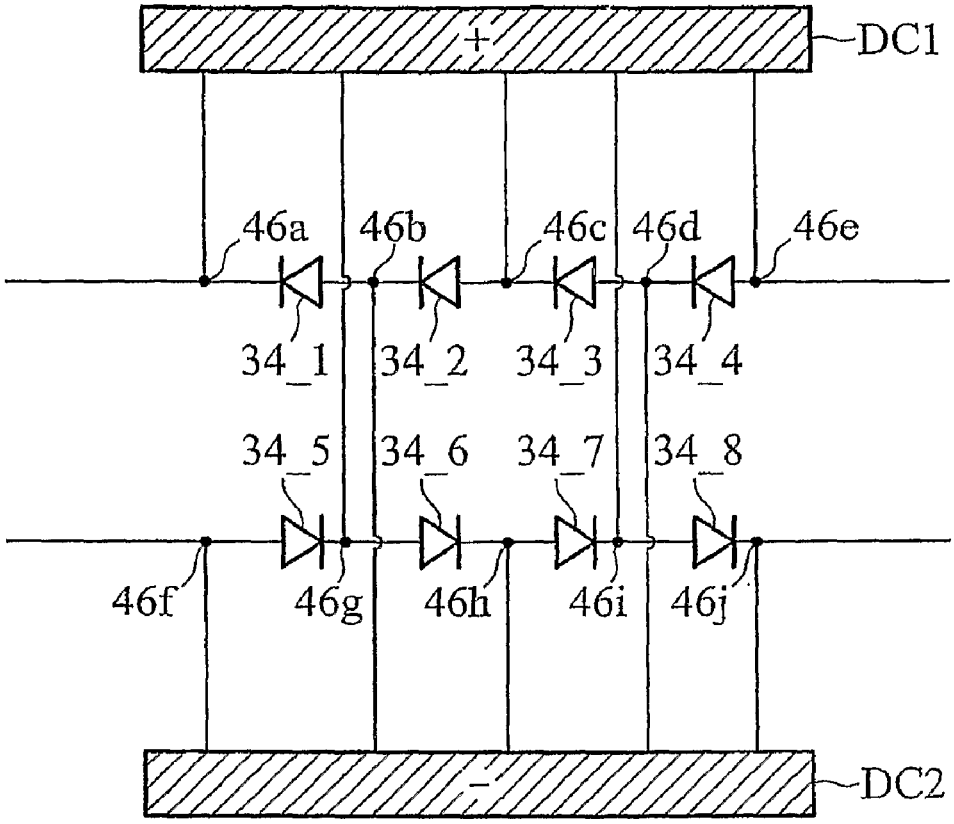
FIG. 10 is a diagram showing the lighting device shown in FIG. 6 being powered by a DC power source.

As shown in FIG. 10, the DC electrodes DC1 and DC2 serving as the positive and negative electrodes of a DC power source (for example, the power source 40) are moved to electrically couple to the conductive wires 45, and thus, a higher voltage (for example, Vdd) of the DC power source may be applied to the voltage feed points 46*g*, 46*c*, 46*i* and 46*e* and a lower voltage (for example, GND) of the DC power source may be applied to the voltage feed points 46*b*, 46*h*, 46*d* and 46*j*. Hence, the DC power source and the micro-diodes 34_2, 34_4, 34_6 and 34_8 form four loops, i.e., each of the micro-diode 34_2, 34_4, 34_6 and 34_8 is biased individually.

Figure 11:
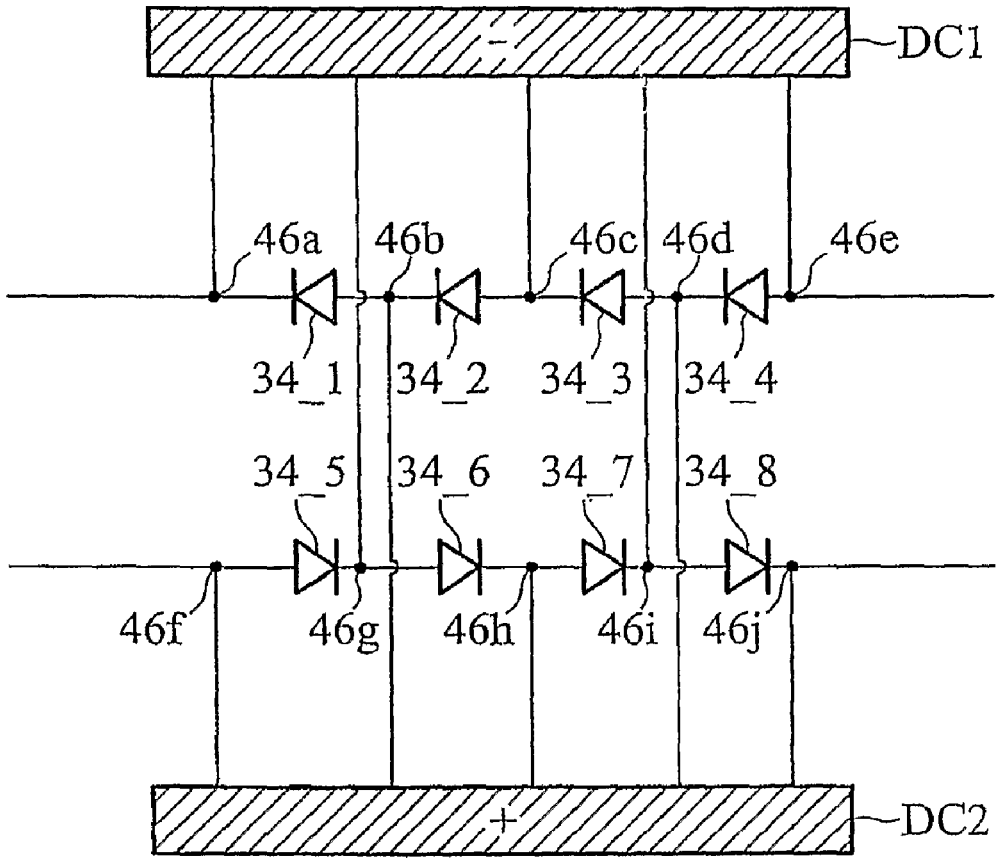
FIG. 11 is another diagram showing the lighting device shown in FIG. 6 being powered by a DC power source.

Alternatively, as shown in FIG. 11, the DC electrodes DC1 and DC2 serving as the negative and positive electrodes of the DC power source are moved to electrically couple to the conductive wires 45, and thus, the lower voltage of the DC power source may be applied to the voltage feed points 46*a*, 46*g*, 46*c* and 46*i* and a higher voltage of the DC power source may be applied to the voltage feed points 46*f*, 46*b*, 46*h* and 46*d*. Similarly, the power source and the micro-diodes 34_1, 34_3, 34_5 and 34_7 form four loops, i.e., each of the micro-diode 34_1, 34_3, 34_5 and 34_7 is biased individually.

Figure 12:
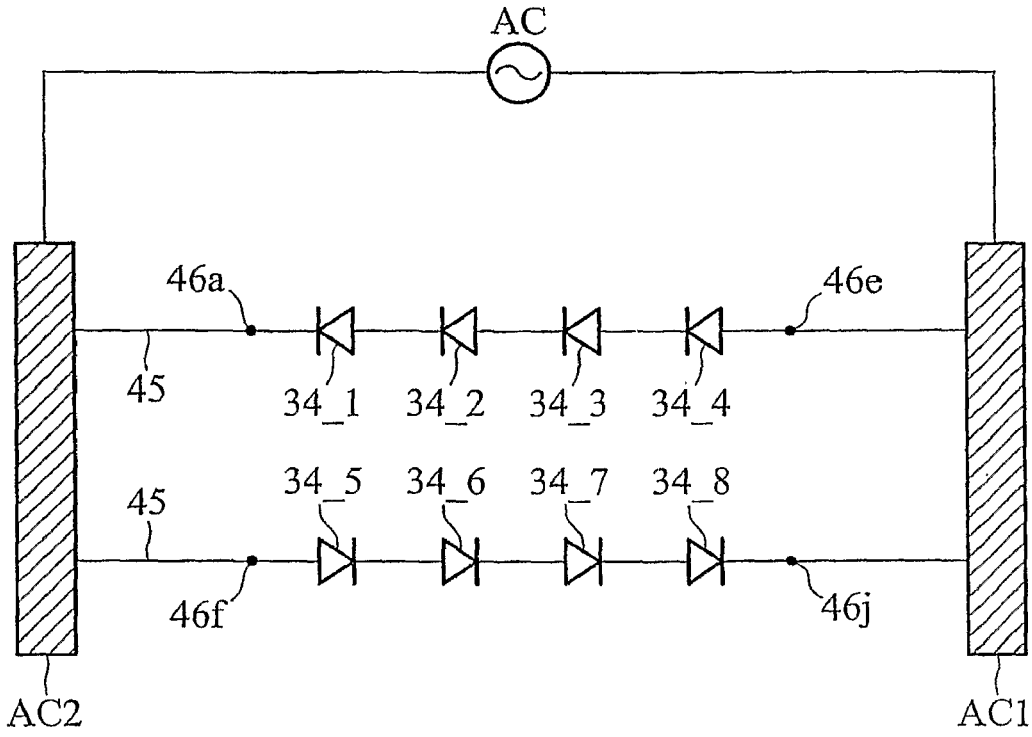
FIG. 12 is a diagram showing the lighting device shown in FIG. 6 being powered by an AC power source.

As shown in FIG. 12, the AC electrodes AC1 and AC2 are moved to electrically couple to the conductive wires 45, and an AC power source and the series of the micro-diodes 34_1~34_4 between the voltage feed points 46*a* and 46*e* form a first loop, and the AC power source and the series of the micro-diodes 34_5~34_8 between the voltage feed points 46*f* and 46*j* form a second loop. The micro-diodes 34_1~34_4 in the first loop are forward biased to turn on during a first half cycle (i.e. the positive half cycle) of the AC power source and the micro-diodes 34_5~34_8 in the second loop are forward biased to turn on during a second half cycle (i.e. the negative half cycle) of the AC power source. Hence, the lighting device 500 can select the voltage feed points 46*a*, 46*e*, 46*f* and 46*j* to couple to the AC power source.

In this embodiment, the lighting device 500 selects different sets of voltage feed points by moving the AC electrodes AC1 and AC2 and the DC electrodes DC1 and DC2, such that the lighting device 500 can be powered with both an AC power source and a DC power source without requiring AC power source to the DC power source conversion. Further, because the micro-diodes are biased individually by the DC power source, the DC power source can be a low voltage source.

Figure 13:
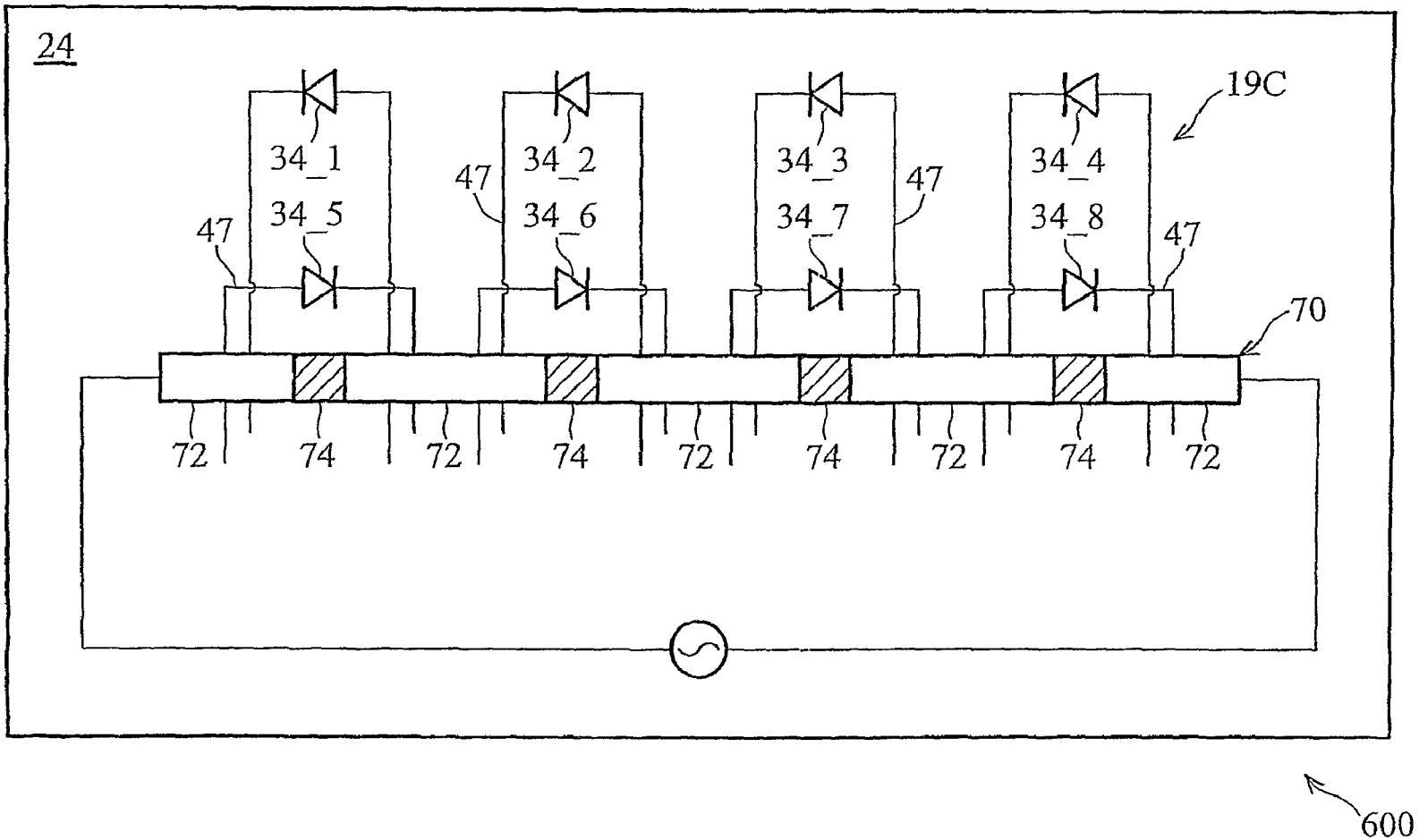
FIG. 13 shows a lighting device with movable AC electrodes.

FIG. 13 shows another embodiment of a lighting device. As shown, the lighting device 600 comprises a plurality of micro-diodes 34_1~34_8 formed on a substrate (not shown), a submount 24 with a conductive wire pattern 19C (i.e., conductive wires 47), a first electrode module 70 and a second electrode module 80 (shown in FIG. 17), in which the first and second electrode module 70 and 80 are movably disposed on the submount 24. The micro-diodes 34_1~34_8 are electrically connected to corresponding conductive wires 47 on the submount 24 by a flip-chip bonding method. The first electrode module 70 comprises a plurality of AC electrodes 72 and a plurality of isolation portions 74, in which each isolation portion 74 is disposed between two AC electrodes 72 to electrically isolate two adjacent AC electrodes 72. When the AC electrodes 72 in the first electrode module 70 are electrically connected to the conductive wires 47 on the submount 24, the micro-diodes 34_1~34_8 are connected in a series of the lighting units 21 as shown in FIG. 14, wherein each lighting unit 21 comprises two micro-diodes connected in parallel.

Figure 14:
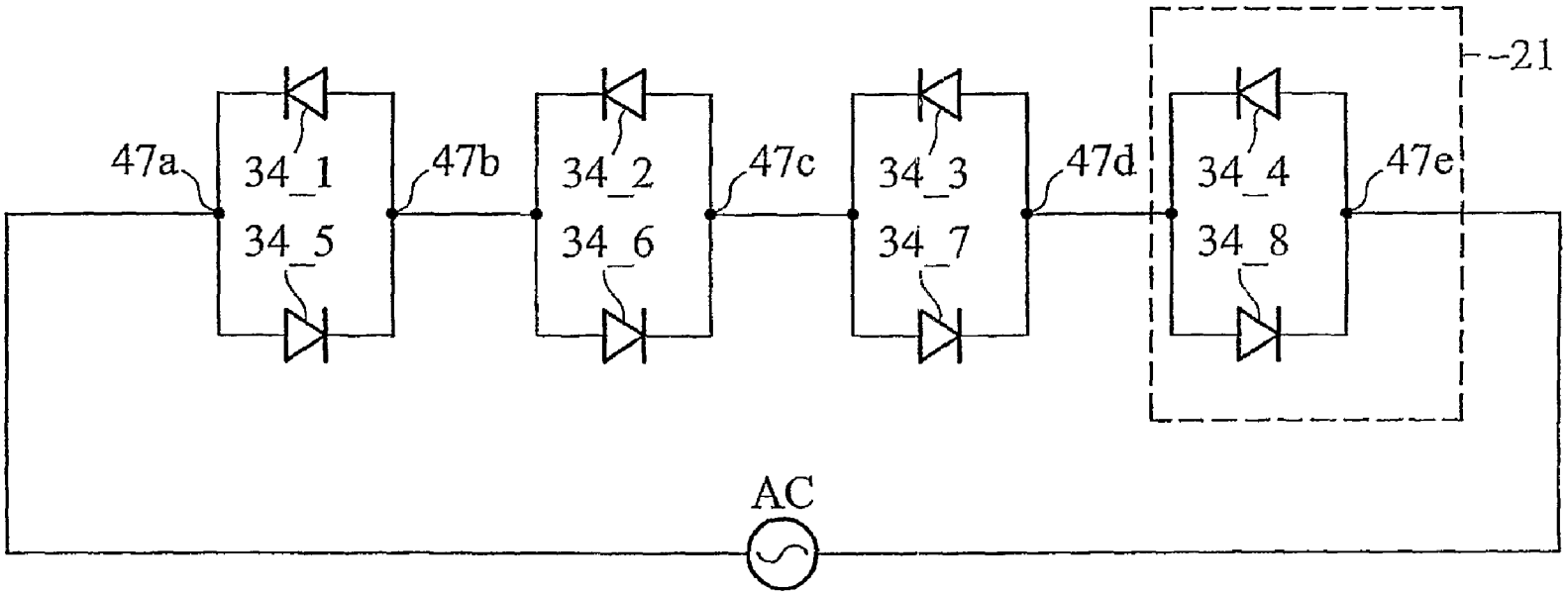
FIG. 14 shows an equivalent circuit diagram of the lighting device shown in FIG. 13.

FIG. 14 shows an equivalent circuit diagram of the lighting device shown in FIG. 13. As shown in FIG. 14, when the first electrode module 70 is electrically coupled to an AC power source, the AC power source and the micro-diodes 34_1~34_4 between the voltage feed points 47*a* and 47*e* form a first loop, and the AC power source and the micro-diodes 34_5~34_8 form a second loop. Namely, the voltage feed points 47*a* and 47*e* are selected to couple the AC power source to the micro-diodes 34_1~34_8, such that the micro-diodes 34_1~34_8 and the AC power source form two loops. The micro-diodes 34_1~34_4 in the first loop are forward biased to turn on during a first half cycle (i.e., the positive half cycle) of the AC power source and the micro-diodes 34_5~34_8 in the second loop are forward biased to turn on during a second half cycle (i.e., the negative half cycle) of the AC power source.

Figure 15:
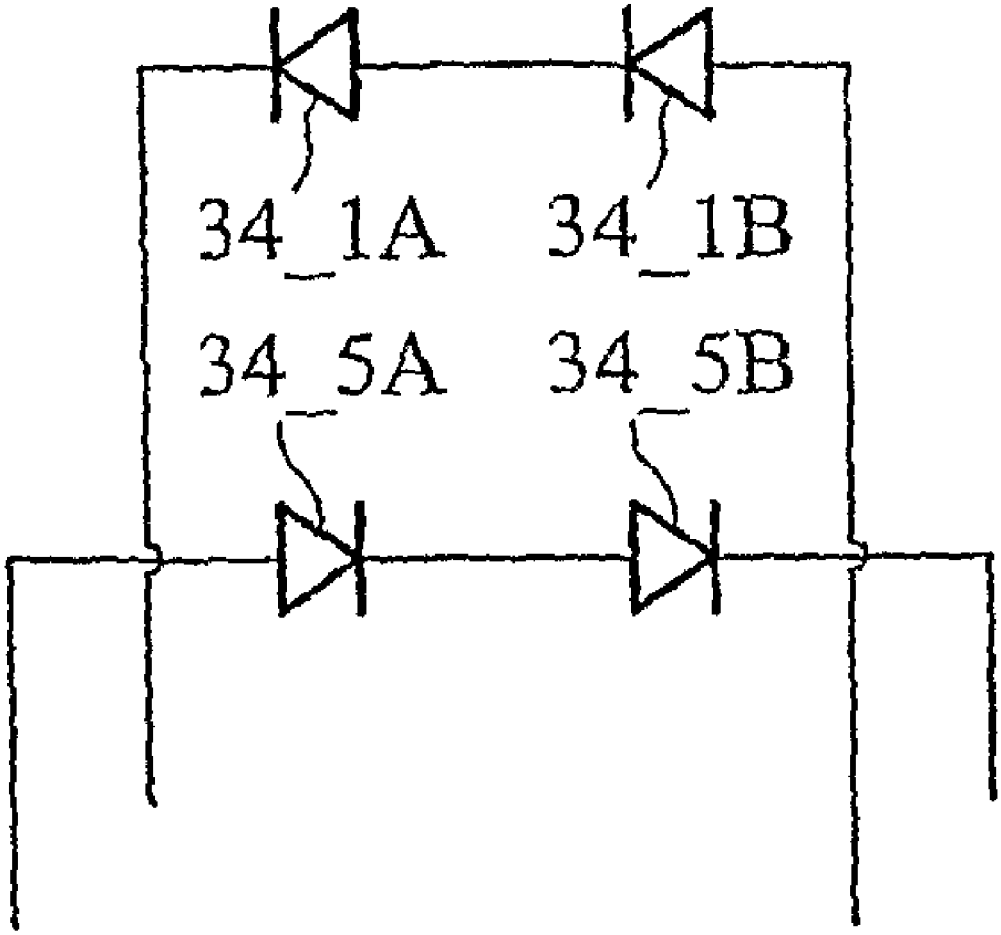
FIG. 15 is another diagram showing the substrate shown in FIG. 7.
Figure 16:
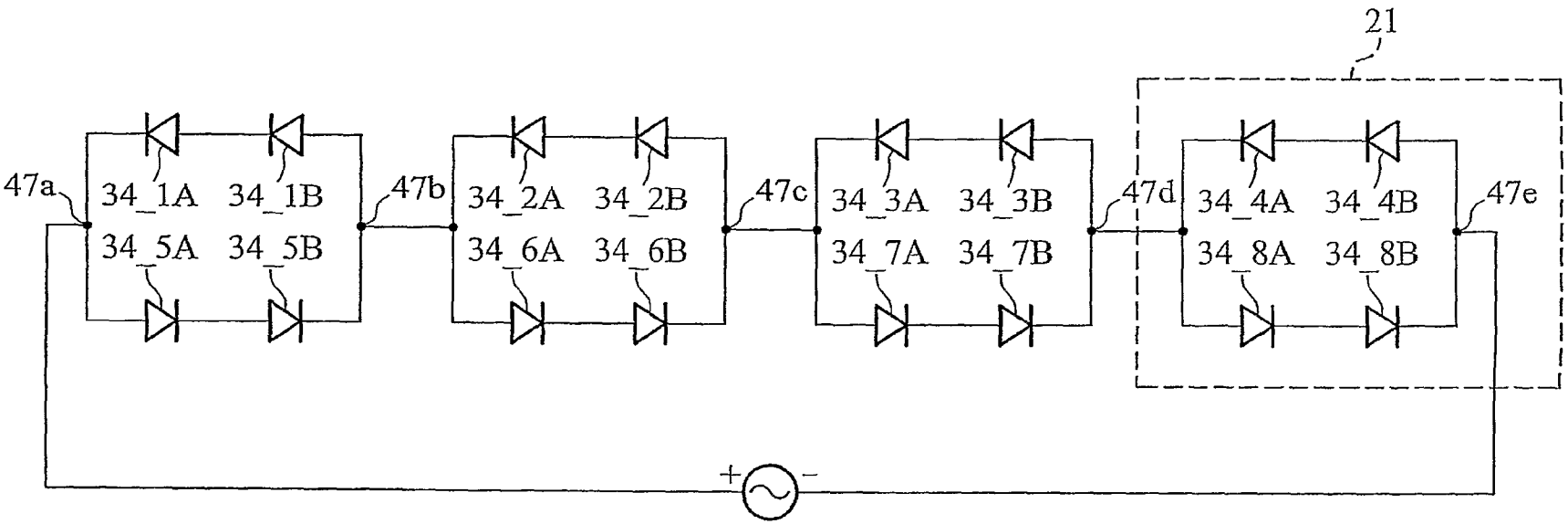
FIG. 16 shows another embodiment of the lighting device shown in FIG. 13.

In some embodiments, each of micro-diodes 34_1~34_8 can be replaced by two micro-diodes as shown in FIG. 15. For example, the micro-diode 34_1 can be replaced by micro-diodes 34_1A and 34_1B, the micro-diode 34_2 can be replaced by micro-diodes 34_2A and 34_2B, and so on. When the AC electrodes 72 in the first electrode module 70 are electrically connected to the conductive wires 47 on the submount 24 and the AC power source is electrically coupled to the first electrode module 70, the micro-diodes 34_1A~34_8A and 34_1B~34_8B are connected in a series of the lighting unit 21 as shown in FIG. 16, wherein each lighting unit 21 comprises two series of micro-diodes connected in parallel. For example, the series of micro-diodes 34_1A and 34_1B and the series of micro-diodes 34_5A and 34_5B are connected in parallel, and the series of micro-diodes 34_2A and 34_2B and the series of micro-diodes 34_6A and 34_6B are connected in parallel, and so on.

The AC power source and the micro-diodes 34_1A~34_4A and 34_1B~34_4B connected in series between the voltage feed points 47*a* and 47*e* form a first loop, and the AC power source and the micro-diodes 34_5A~34_5A and 34_8B~34_8B form a second loop. The micro-diodes 34_1A~34_4A and 34_1B~34_4B in the first loop are forward biased to turn on during a first half cycle (i.e. the positive half cycle) of the AC power source and the micro-diodes 34_5A~34_8A and 34_5B~34_8B in the second loop are forward biased to turn on during a second half cycle (i.e. the negative half cycle) of the AC power source.

Figure 17:
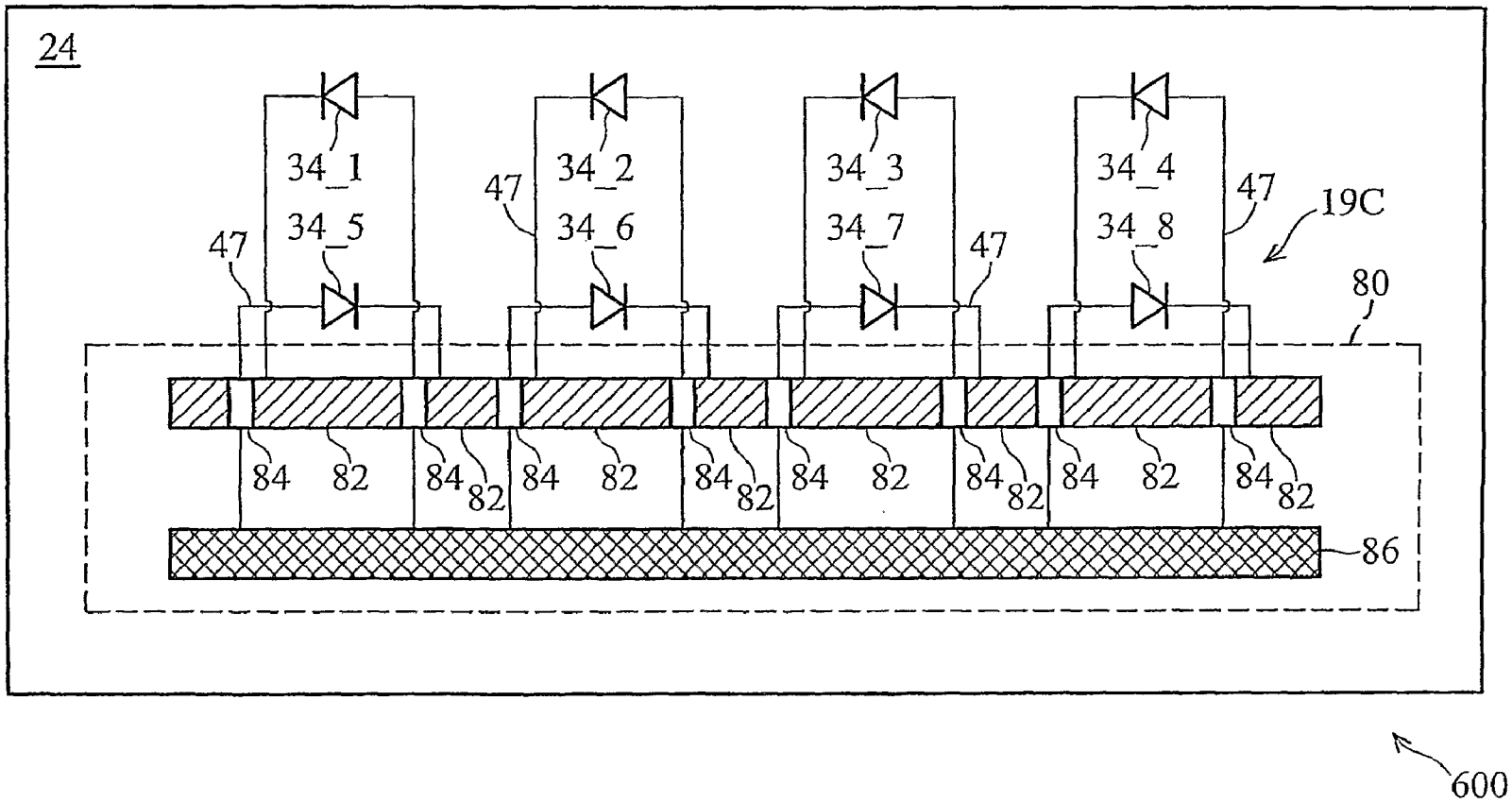
FIG. 17 shows a lighting device with movable DC electrodes.

As shown in FIG. 17, the second electrode module 80 comprises a plurality of first DC electrodes 82, a plurality of isolation portions 84 and a second DC electrode 86, in which each isolation portion 84 is disposed between two first DC electrodes 82 to electrically isolate two adjacent first DC electrodes 82. When the first DC electrodes 82 and the second DC electrode 86 in the second electrode module 80 are electrically connected to the conductive wires 47 on the submount 24, cathodes of the micro-diodes 34_1~34_8 are connected to corresponding first DC electrodes 82 respectively and all anodes of the micro-diodes 34_1~34_8 are connected to the second DC electrode 86. In this case, cathodes and anodes of the micro-diodes 34_1~34_8 can serve as voltage feed points and be coupled to the first DC electrodes 82 and the second DC electrode 86 respectively.

Figure 18:
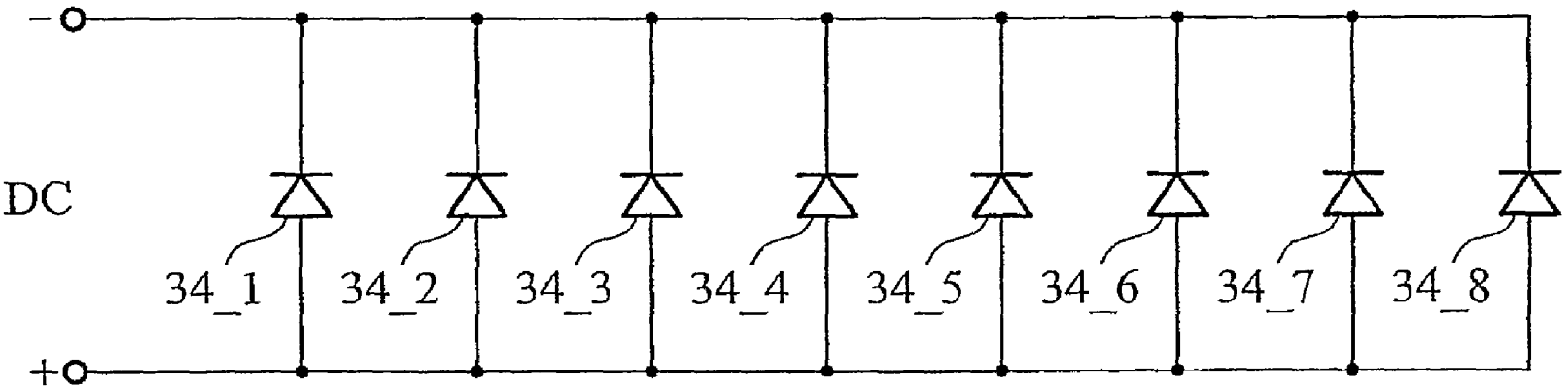
FIG. 18 shows an equivalent circuit diagram of the lighting device shown in FIG. 17.

As shown in FIG. 18, when the second electrode module 80 is electrically coupled to a DC power source, a higher voltage of the DC power source is coupled to the anodes of the micro-diodes 34_1~34_8 by the second DC electrode 86, and the lower voltage (for example, a ground voltage) is coupled to the cathodes of the micro-diodes 34_1~34_8 by the first DC electrode 82. Thus, the micro-diodes 34_1~34_8 are forward biased (turned on) individually by the DC power source. Namely, the DC power source and the micro-diodes 34_1~34_8 form eight loops by the first and second DC electrodes 82 and 86 and the conductive wire pattern 19C (i.e. conductive wires 47).

Figure 19:
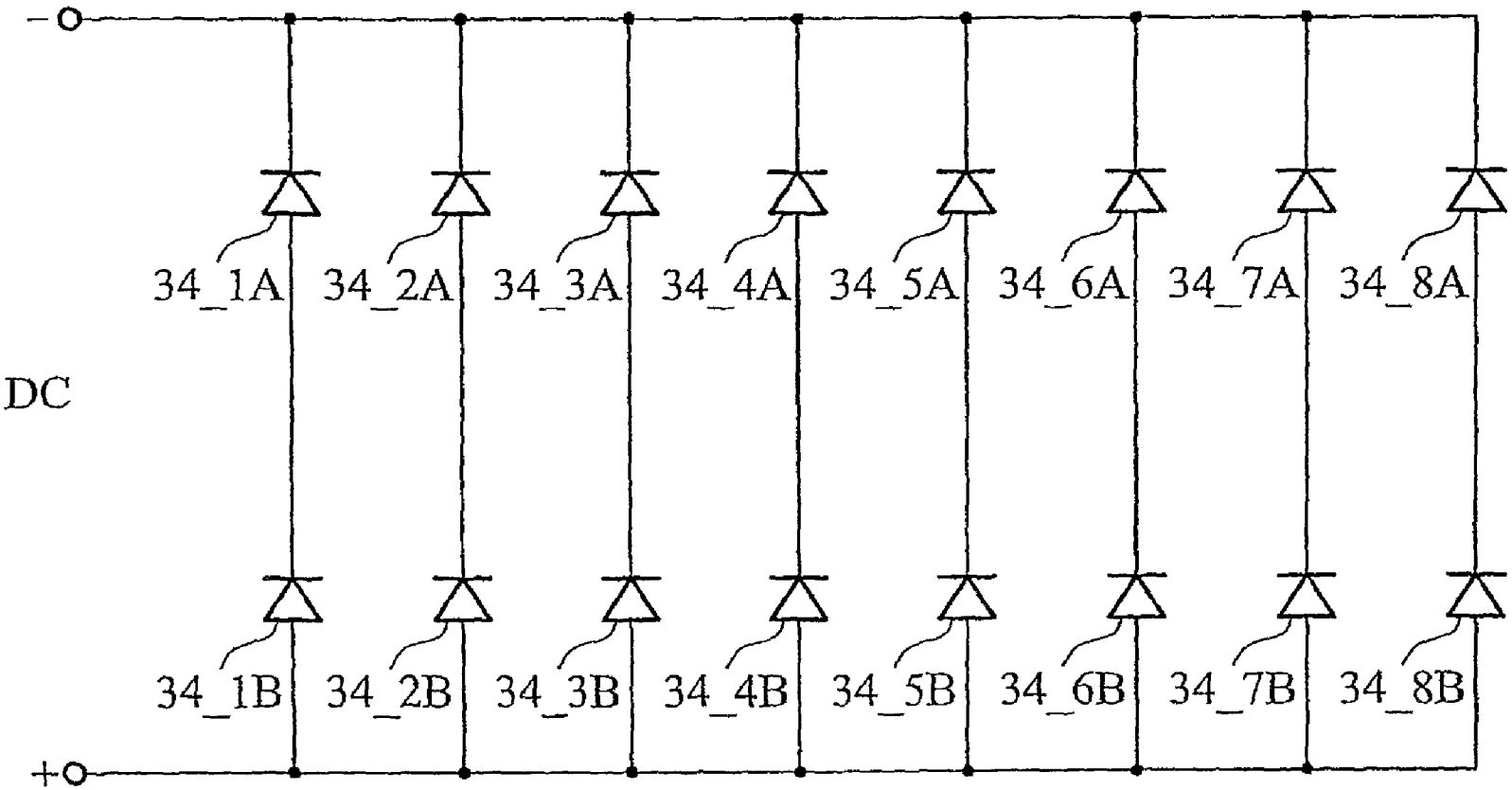
FIG. 19 shows another embodiment of a lighting device with movable DC electrodes.

In some embodiments, each of micro-diodes 34_1~34_8 can be replaced by two micro-diodes. As shown in FIG. 19, the micro-diode 34_1 can, for example, be replaced by micro-diodes 34_1A and 34_1B, the micro-diode 34_2 can be replaced by micro-diodes 34_2A and 34_2B, and so on. In this case, cathodes of the micro-diodes 34_1A~34_8A can serve as voltage feed points and be coupled to the first DC electrodes 82 and anodes of the micro-diodes 34_1A~34_8A can also serve as voltage feed points and be coupled to the second DC electrode 86. When the second electrode module 80 is electrically coupled to the DC power source, the higher voltage of the DC power source is coupled to the anodes of the micro-diodes 34_1B~34_8B by the second DC electrode 86, and the lower voltage (for example, a ground voltage) is coupled to the cathodes of the micro-diodes 34_1A~34_8A by the first DC electrode 82. Namely, the power source and the micro-diodes 34_1~34_8 form eight loops by the first and second DC electrodes 82 and 86 and the conductive wire pattern 19C (i.e. conductive wires 47). For example, the series of micro-diodes 34_1A and 34_1B and the DC power source form a first loop, the series of micro-diodes 34_2A and 34_2B and the DC power source form a second loop, and so on. Thus, each two of the micro-diodes 34_1A-34_8A and 34_1B~34_8B are forward biased (turned on) individually by the DC power source. In some embodiments, each of the micro-diodes 34_1~34_8 can also be replaced by three or more micro-diodes, of which the structure and operation thereof are omitted for brevity.

Thus, the lighting device 600 selects different sets of voltage feed points by moving electrode modules, such that the lighting device 600 can be powered with both an AC power source and a DC power source without requiring AC power source to the DC power source conversion.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

The invention claimed is:

1. A lighting device, comprising:

a lighting module comprising:

a plurality of micro-diodes formed on a substrate; and a conductive wire pattern connecting to the micro-diodes, wherein the conductive wire pattern has at least three voltage feed points; and a selection unit used to be coupled to a power source and selecting at least two of the voltage feed points, such that a portion of the micro-diodes and the power source form at least one loop thereby turning on the micro-diodes in the loop.

2. The lighting device of claim 1, wherein the selection unit comprises:

at least two DC electrodes and least two AC electrodes electrically connected to the conductive wire pattern; and an identification unit determining whether the power source is DC or AC and selectively coupling the power source to the DC electrodes or the AC electrodes according to the determined result, such that some of the micro-diodes and the power source form at least one loop by a portion of the voltage feed points in the conductive wire pattern, thereby turning on the micro-diodes in the loop.

3. The lighting device of claim 2, wherein the selection unit further comprises a plurality of isolation units controlling a connection between the conductive wire pattern and the DC and AC electrodes according to the determined result of the identification unit.

4. The lighting device of claim 1, wherein the conductive wire pattern connects to the micro-diodes to form at least one series of micro-lighting units each comprising at least two of the micro-diodes, and the two micro-diodes in the each of the micro-lighting units are reversely connected in parallel.

5. The lighting device of claim 1, wherein the conductive wire pattern connects to the micro-diodes to form a plurality of series of micro-lighting units each comprising at least two of the micro-diodes, the two micro-diodes in each micro-lighting units are reversely connected in parallel, and the selection unit selects the voltage feed points to turn on one or more series of the micro-diodes according to a power setting signal.

6. The lighting device of claim 1, wherein the selection unit selects the voltage feed points according to a relationship between the power source and an equivalent withstand voltage of the micro-diodes connected by the conductive wire pattern.

7. The lighting device of claim 1, wherein the selection unit selects the voltage feed points according to magnitude of the power source.

8. The lighting device of claim 7, wherein the selection unit selects two of the voltage feed points such that a portion of the micro-diodes and the power source form one loop thereby turning on the micro-diodes in the loop when the power source provides a first voltage, and the selection unit selects three of the voltage feed points such that a portion of the micro-diodes and the power source form two loops thereby turning on the micro-diodes in two loops when the power source provides a second voltage which is smaller than the first voltage.

9. The lighting device of claim 7, the selection unit comprises:

an identification unit determining the magnitude of the power source and generating a result signal accordingly; and an output unit selectively coupling the power source to the at least two voltage feed points in the conductive wire pattern according to the result signal, such that some of the micro-diodes and the power source form at least one loop thereby turning on the micro-diodes in the loop.

10. The lighting device of claim 1, wherein the selection unit selects the voltage feed points by determining whether the power source is DC or AC.

11. The lighting device of claim 1, wherein the lighting module further comprises a submount, wherein the conductive wire pattern is formed by a plurality of conductive wires on the substrate, a plurality of conductive wires on the submount or combinations thereof.

12. The lighting device of claim 2, wherein the conductive wire pattern connects to the micro-diodes in at least two series.

13. The lighting device of claim 12, wherein when the power source is AC, the selection unit couples the power source to the two series of the micro-diodes through the AC electrodes turns on one of the two series of the micro-diodes during a positive half cycle of the power source and turns on the other of the two series of the micro-diodes during a negative half cycle of the power source.

14. The lighting device of claim 13, wherein when the power source is DC, the selection unit couples the power source to the micro-diodes by the DC electrodes, such that a plurality of series of micro-diodes are biased individually by the power source and each series of the micro-diodes has one or more micro-diodes.

15. A lighting device, comprising:

a lighting module comprising:

a plurality micro-diodes formed on a substrate; and a conductive wire pattern connecting to the micro-diodes;

at least two alternating current (AC) electrodes electrically coupling an AC power source to the micro-diodes by the conductive wire pattern, such that a first portion of the micro-diodes are turned on during a positive half cycle of the AC power source and a second portion of the micro-diode are turned on during a negative half cycle of the AC power source; and at least two direct current (DC) electrodes, coupling a DC power source to the micro-diodes by the conductive wire pattern.

16. The lighting device of claim 15, wherein the conductive wire pattern comprises a plurality of voltage feed points.

17. The lighting device of claim 16, wherein the AC electrodes are movable thereby controlling a connection between a first set of the voltage feed points and the AC power source.

18. The lighting device of claim 17, wherein the conductive wire pattern connects to the micro-diodes in at least two series of micro-diodes, and the AC electrodes couple the AC power source to the conductive wire pattern such that one of the two series of micro-diodes are turned on during the positive half cycle of the AC power source and the other series of micro-diodes are turned on during the negative half cycle of the AC power source.

19. The lighting device of claim 16, wherein the DC electrodes are movable thereby controlling a connection between a second set of the voltage feed points and the DC power source.

20. The lighting device of claim 19, wherein the DC electrodes and the conductive wire pattern connects the micro-diode in a plurality of series of micro-diodes, such that the plurality of series of micro-diodes are biased individually by the power source and each series of the micro-diodes has one or more micro-diodes.

* * * * *